US010822846B2

(12) United States Patent
Perring et al.

(10) Patent No.: US 10,822,846 B2
(45) Date of Patent: Nov. 3, 2020

(54) LATCH MECHANISM FOR A VEHICLE

(71) Applicants: GM GLOBAL TECHNOLOGY OPERATIONS LLC, Detroit, MI (US); PyeongHwa Automotive, Daegu (KR)

(72) Inventors: John Perring, Sterling Heights, MI (US); James N. Nelsen, Howell, MI (US); Hee Ra Park, Daegu (KR)

(73) Assignees: GM Global Technology Operations LLC, Detroit, MI (US); PyeongHwa Automotive, Daegu (KR)

( * ) Notice: Subject to any disclaimer, the term of this patent is extended or adjusted under 35 U.S.C. 154(b) by 609 days.

(21) Appl. No.: 15/693,809

(22) Filed: Sep. 1, 2017

(65) Prior Publication Data

US 2019/0071899 A1 Mar. 7, 2019

(51) Int. Cl.

*E05B 83/24* (2014.01)
*E05B 15/04* (2006.01)
*E05B 85/02* (2014.01)

(52) U.S. Cl.

CPC ..... *E05B 83/24* (2013.01); *E05B 15/04* (2013.01); *E05B 85/02* (2013.01); *E05Y 2900/536* (2013.01)

(58) Field of Classification Search

CPC ..... E05B 63/06; E05B 59/00; E05B 65/0858; E05B 63/14; E05B 63/0056; Y10T 292/06

See application file for complete search history.

(56) References Cited

U.S. PATENT DOCUMENTS 3,397,906 A * 8/1968 Beckman ..... E05B 83/16 292/29
4,593,945 A * 6/1986 Arute ..... F24C 15/022 292/201
4,936,611 A * 6/1990 Palvolgyi ..... E05B 83/16 292/216
5,118,146 A * 6/1992 Watanuki ..... E05B 83/16 292/216
5,445,421 A * 8/1995 Ferrara ..... E05B 83/24 292/216

(Continued)

FOREIGN PATENT DOCUMENTS

CN 1580475 A 2/2005
CN 102016206 A 4/2011

(Continued)

*Primary Examiner* — Mark A Williams
(74) *Attorney, Agent, or Firm* — Quinn IP Law

(57) ABSTRACT

A latching mechanism configured to fasten a hood panel to a vehicle body for covering a vehicle under-hood compartment includes a fork bolt positionable between a first position and at least one second position having a channel configured to capture the striker. A device releasably engages the fork bolt to adjust the fork bolt from the first position to the second position. A latch is positionable between at least the second position and a third position and includes a body including a primary catch portion and a secondary catch portion configured to releasably engage the striker in the second position. An actuator cooperates with the device and includes a projection configured to engage a portion of the latch body to adjust the latch from the second position to the third position. The secondary catch portion releases the striker in the third position.

17 Claims, 4 Drawing Sheets

(56) References Cited

U.S. PATENT DOCUMENTS

| | | | | |
|---|---|---|---|---|
| 5,738,393 | A * | 4/1998 | Chao | E05B 83/24 292/216 |
| 5,853,060 | A | 12/1998 | Chao et al. | |
| 6,106,033 | A * | 8/2000 | Ruckert | E05B 83/16 292/216 |
| 2002/0101082 | A1* | 8/2002 | Schwaiger | E05B 83/16 292/216 |
| 2006/0006660 | A1* | 1/2006 | Seo | E05B 83/24 292/24 |
| 2011/0025077 | A1* | 2/2011 | Meyer | E05B 83/16 292/216 |
| 2012/0074715 | A1* | 3/2012 | Kim | B60R 21/34 292/201 |
| 2014/0054903 | A1* | 2/2014 | Kim | E05B 83/24 292/96 |
| 2016/0186471 | A1* | 6/2016 | Cho | E05B 83/24 292/97 |

FOREIGN PATENT DOCUMENTS

| | | | |
|---|---|---|---|
| CN | 103132807 | A | 6/2013 |
| DE | 20016896 | U1 | 2/2002 |
| DE | 102004029848 | A1 | 1/2006 |
| DE | 102004063239 | B4 | 5/2007 |
| DE | 102007003292 | A1 | 7/2008 |
| DE | 102007007633 | A1 | 8/2008 |
| EP | 0894918 | A1 | 2/1999 |

* cited by examiner

LATCH MECHANISM FOR A VEHICLE

INTRODUCTION

The disclosure relates to a hood latch mechanism for a motor vehicle.

In motor vehicles, a hood or bonnet is a moveable, typically hinged, panel configured to selectively cover and permit access to a compartment defined by the vehicle body. In vehicles with a forward mounted engine, the hood permits access to the engine for maintenance. In vehicles with a mid-body or rearward mounted engine, the hood covers a storage compartment disposed in the forward portion of the vehicle.

Commonly, a vehicle hood is held down by a concealed latch. Such a latch is generally designed to protect the vehicle or the compartment contents from theft, damage, and sudden opening of the hood while the vehicle is in motion. A hood release system is common on the most vehicles, and typically includes an interior compartment hood latch handle, a hood release cable, and a hood latch assembly that cooperate to release and open the hood panel for access to the covered compartment.

SUMMARY

A vehicle having a vehicle body defining a compartment includes a hood panel configured to cover the compartment and a striker extending therefrom. A latching mechanism releasably engages the striker and is adjustable between a first or latched position and at least one second or unlatched position. The latching mechanism includes a housing securable to a portion of the vehicle body. The housing includes a first side, an opposing second side and at least one cam surface formed in a central region of the housing defined between the first and second sides.

A fork bolt is disposed proximate the housing and is positionable between the first position and a second or first unlatched position. The fork bolt includes a channel configured to capture the striker to fasten the hood panel to the vehicle body in the latched position. A device is disposed proximate the housing to releasably engage the fork bolt. The device is actuated to adjust the fork bolt from the first position to the second position.

A latch is disposed proximate the housing and is positionable between at least the second position and a third or second unlatched position. The latch includes a body including a primary catch portion and a secondary catch portion positioned relative to the central region of housing. The secondary catch portion is configured to releasably engage the striker in the second position. An actuator cooperates with the device and is positionable between the second position and the third position. The actuator includes a projection configured to engage a portion of the latch body to adjust the latch from the second position to the third position. The secondary catch portion releases the striker in the third position to unfasten the hood panel from the vehicle body.

The latching mechanism includes a limiter and a slot formed in the latch body. The slot cooperates with the limiter to define a range of travel of the latch. The striker cooperates with the primary catch portion of the latch to selectively fasten the hood panel to the vehicle body. The latch of the latching mechanism also includes a surface arranged between the primary catch portion and the secondary catch portion configured to guide the striker between the primary catch portion and the secondary catch portion when the striker is positioned between the first position and the second position.

The latching mechanism includes a first resilient element configured to selectively apply a force to preload the latch to facilitate closure of the under-hood compartment in the first position and preload the secondary catch portion to limit the position of the hood panel in the second position. A second resilient element or member is configured to apply a preload force directed to move the fork bolt from the first position to the second position to move the hood panel away from the vehicle body. A third resilient element or member is configured to apply a force to a device to release the fork bolt from the first position to the second position in response to actuation of the device.

The latching mechanism also includes a fourth resilient element having a first portion positioned on the housing and a second portion operatively engaging the latch body. The fourth resilient element is biased to retain the secondary catch portion of the latch adjacent the central region of the housing to retain the striker in the secondary catch portion in the second position.

In another embodiment of the disclosure, a latching mechanism configured to releasably engage a striker of a hood panel to selectively fasten the hood panel to a vehicle body and adjustable between a first or latched position and at least one second or unlatched position includes a housing securable to a portion of the vehicle body. The housing includes a first side, an opposing second side and at least one cam surface formed in a central region of the housing defined between the first and second sides.

A fork bolt is disposed proximate the housing and is positionable between the first position and a second or first unlatched position. The fork bolt includes a channel configured to capture the striker to fasten the hood panel to the vehicle body in the first position. A device is disposed proximate the housing to releasably engage the fork bolt. The device is actuated to adjust the fork bolt from the first position to the second position.

A latch is disposed proximate the housing and is positionable between at least the second or first unlatched position and a third or second unlatched position. The latch includes a body including a primary catch portion and a secondary catch portion positioned relative to the central region of housing. The secondary catch portion is configured to releasably engage the striker in the second position. An actuator cooperates with the device and is positionable between the second position and the third position. The actuator includes a projection configured to engage a portion of the latch body to adjust the latch from the second position to the third position. The secondary catch portion releases the striker in the third position to unfasten the hood panel from the vehicle body.

The latching mechanism includes a limiter and a slot formed in the latch body. The slot cooperates with the limiter to define a range of travel of the latch. The striker cooperates with the primary catch portion of the latch to selectively fasten the hood panel to the vehicle body. The latch of the latching mechanism also includes a surface arranged between the primary catch portion and the secondary catch portion configured to guide the striker between the primary catch portion and the secondary catch portion when the striker is positioned between the first position and the second position.

The latching mechanism includes a first resilient element configured to selectively apply a force to preload the latch to facilitate closure of the under-hood compartment in the first position and preload the secondary catch portion to limit the position of the hood panel in the second position. A second resilient element or member is configured to apply a preload force directed to move the fork bolt from the first position to the second position to move the hood panel away from the vehicle body. A third resilient element or member is configured to apply a force to a device to release the fork bolt from the first position to the second position in response to actuation of the device.

The latching mechanism also includes a fourth resilient element having a first portion positioned on the housing and a second portion operatively engaging the latch body. The fourth resilient element is biased to retain the secondary catch portion of the latch adjacent the central region of the housing to retain the striker in the secondary catch portion in the second position.

The above features and advantages, and other features and advantages of the present disclosure, will be readily apparent from the following detailed description of the embodiment (s) and best mode(s) for carrying out the described disclosure when taken in connection with the accompanying drawings and appended claims.

DETAILED DESCRIPTION

Figure 1:
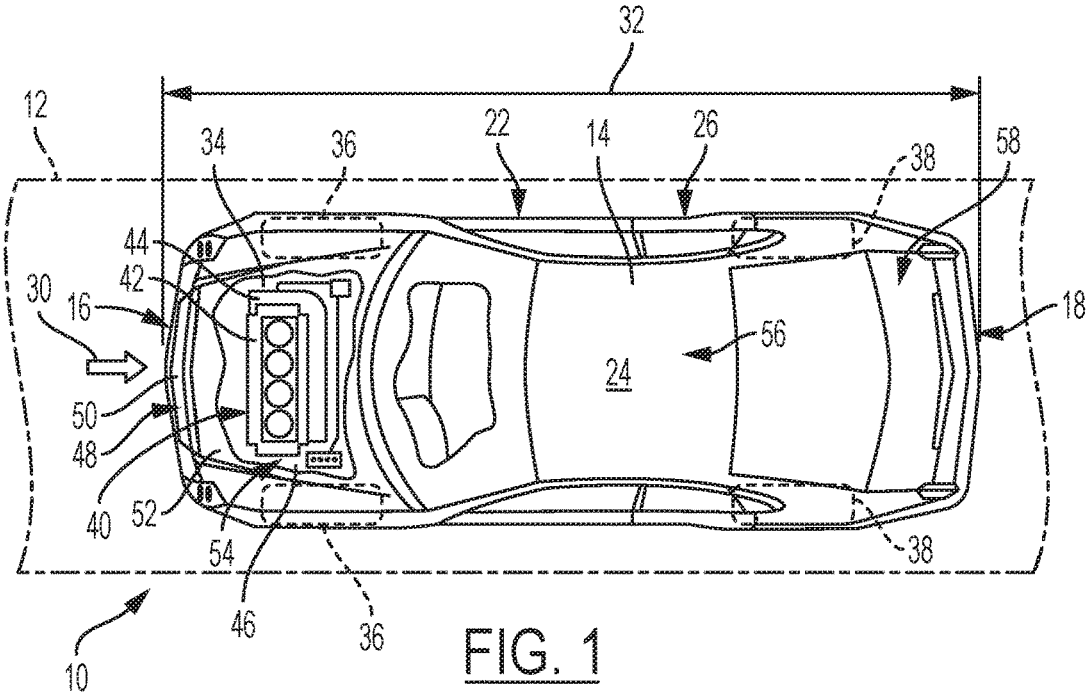
FIG. 1 is a schematic top view of a vehicle showing a partially sectioned hood panel and an under-hood compartment covered thereby, according to the disclosure.

Referring to the drawings, wherein like reference numbers correspond to like or similar components throughout the several Figures, an example vehicle 10 is shown schematically in FIG. 1. The vehicle 10 may include, but not be limited to, a commercial vehicle, industrial vehicle, passenger vehicle, aircraft, watercraft, train or any mobile platform. It is also contemplated that the vehicle 10 may be any mobile platform, such as an airplane, all-terrain vehicle (ATV), boat, personal movement apparatus, robot and the like to accomplish the purposes of this disclosure.

The vehicle 10 in FIG. 1 is positioned relative to a road surface 12. The vehicle 10 includes a vehicle body 14. The vehicle body 14 illustrated in the Figures defines six body sides. The six body sides include a first end or front end 16, an opposing second end or rear end 18, a first lateral portion or left side 20 generally extending between the first and second ends 16, 18, and an opposing second lateral portion or right side 22. The vehicle body 14 further includes a top body portion 24, which may include at least a vehicle roof portion, and an opposing lower body portion or underbody 26. A passenger compartment 28 is defined in the vehicle body 14.

As understood by those skilled in the art, the first or front end 16 may be configured to face oncoming ambient airflow 30 when the vehicle 10 is in motion relative to the road surface 12. Each of the left side, right side, top, and underbody body sections, 20, 22, 24, and 26, respectively, is configured to span a distance 32 between the front and rear ends 16, 18 of the body 14.

The vehicle 10 includes a first set of one or more wheels 36 arranged between the first and second vehicle body ends 16, 18, proximate the left and right sides 20, 22. The one or more wheels includes a first set of wheels 36 disposed proximate the first or front end 16 of the vehicle 10 and a second set of one or more wheels 38 disposed proximate the second or rear end 18 of the vehicle 10. As shown in FIG. 1, the first set of one or more wheels 36 includes a pair of front wheels that are rotatably connected to the vehicle 10 and rotate about an axis while the second set of one or more wheels 38 includes a pair of rear wheels that are rotatably connected to the vehicle 10 and rotate about an axis.

The vehicle 10 also includes a powertrain 40 that may include an internal combustion engine 42 for generating engine torque. The powertrain 40 may also include a transmission 44 operatively connecting the engine 42 to at least some of the road wheels 36, 38 for transmitting engine torque thereto and thereby put the vehicle 10 in motion. The powertrain 40 of the vehicle 10, if the vehicle is a hybrid type, may include one or more motor-generators, none of which are shown, but the existence of which can be appreciated by those skilled in the art. Efficiency of a vehicle powertrain 40 is generally influenced by its design, as well as by the various loads the powertrain 40 sees during its operation.

The vehicle body 14 defines a compartment 46 for housing the powertrain 40. As described above, the compartment 46 shown in FIG. 1 houses the powertrain 40. However, it is understood that the compartment 46 may be configured as a storage compartment or other vehicle space if the powertrain 40 of the vehicle 10 is positioned in a central or rear portion of the vehicle 10.

As shown, the vehicle body 14 also includes a vehicle fascia 48 arranged at the front end 16. The fascia 48 defines at least one opening 50 configured to receive at least some of the oncoming ambient airflow 30, which may be used for cooling the powertrain 40. Generally, the at least one opening 50 that is provided in the front end 16 of the vehicle 10, such as the grille openings 50, as well as various protruding features on the surface of the vehicle body 14, tend to impact the vehicle's aerodynamic signature. Although one grille opening 50 is depicted and described, nothing precludes the vehicle 10 from having a greater number of grille openings for admitting the ambient airflow 30 into the compartment 46 from the ambient atmosphere.

The vehicle 10 also includes a hood panel or bonnet 52 configured to cover the compartment 46 and thereby define an under-hood compartment 54 for housing the powertrain 40. The vehicle 10 may also include a vehicle roof, generally represented by numeral 56, and a trunk lid 58. Corresponding to the specifically shown front-engine configuration of the vehicle 10, the hood panel 52 is depicted as arranged generally proximate the front end 16, while the trunk lid 58 is arranged generally proximate the rear end 18 of the vehicle body 14 of the vehicle 10.

The under-hood compartment 54 of the vehicle 10 may be configured to accept a number of alternative distinct powertrains. A specific powertrain may be selected based on the intended use of the vehicle 10 or the general preference of the vehicle's user. Accordingly, during the initial design of the vehicle 10, the under-hood compartment 54 is typically configured to accommodate each of the alternative powertrains. Hence, although the physical size of the alternative powertrains, as well as the power output of the respective engines, may be vastly different, the overall size and layout of the particular under-hood compartment 54 remains relatively unchanged.

Figure 2A:
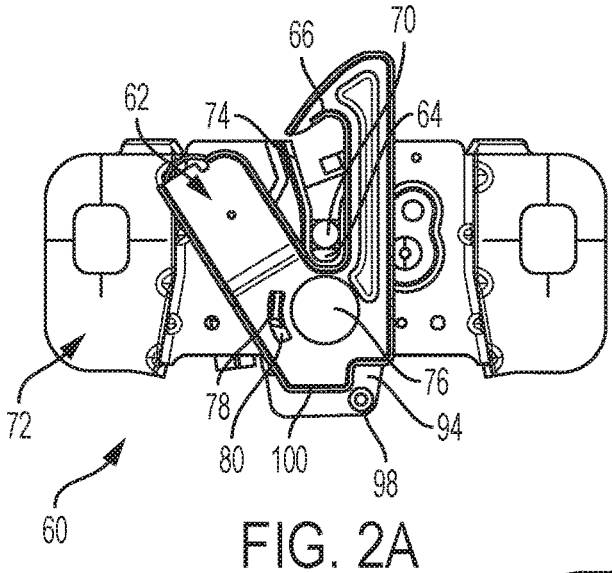
FIGS. 2A-2B are schematic front and rear views of the mechanism shown in a latched position.
Figure 2B:
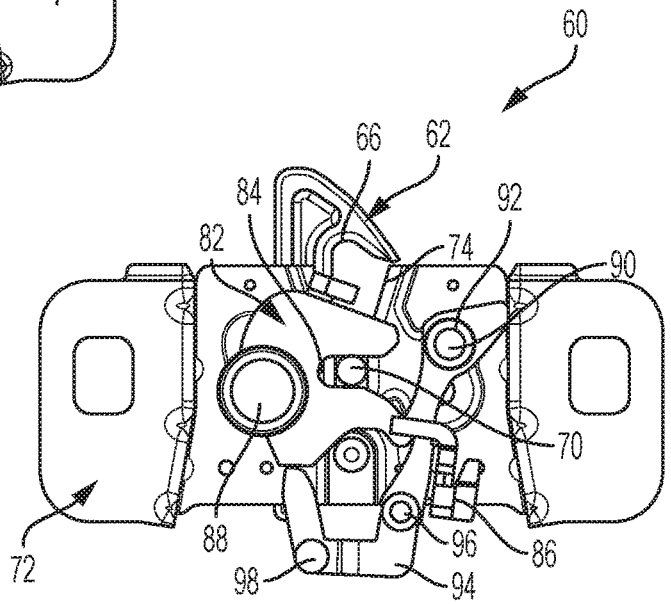

Referring additionally now to FIGS. 2A-2B, the vehicle 10 includes a latching mechanism 60 illustrated in first position. The first position of the latching mechanism 60 may also be referred to as a latch or latched position or an unactuated position. The latching mechanism 60 may be configured to selectively fasten and releasably secure the hood panel 52 as shown in FIG. 1 proximate to the vehicle body 14 such that the hood panel 52 maintains closure of the compartment 46. For purposes of clarity, FIG. 2A illustrates the latching mechanism 60 from a forward portion of the vehicle 10 proximate the front end 16 of the vehicle 10, while FIG. 2B illustrates the mechanism from a rearward portion of the vehicle 10, such as from the position of the passenger compartment 28.

While the latching mechanism 60 is illustrated in one non-limiting configuration in FIGS. 2A-2B, it is understood that the latching mechanism 60 may be installed in a variety of positions and arrangements depending upon the configuration of the vehicle 10. For example, the front or forward view may be reversed with the rear or rearward views such that the latch 62 may be mounted to either the front or the rear of the tie bar structure. Further, the latching mechanism 60 may be configured for use in right hand drive and left hand drive vehicle configurations in order to dictate the cable going to the driver's side of the vehicle. Additionally, the latching mechanism 60 may use different part configurations than as illustrated. For example, in the case of a latching mechanism 60 disposed on the rearward side of the tie bar structure on a left hand drive vehicle, a part of the latching mechanism 60 for use with a right hand drive vehicle may be used to allow a cable exit towards the driver's side of the vehicle 10.

The latching mechanism 60 includes a latch 62 having a latch body pivotally connected to and rotatably positionable relative to a housing 72 having a primary catch portion 64 configured to facilitate or maintain closure of the under-hood compartment 54 via the hood panel 52 being pulled against the vehicle body 14 when the latching mechanism is in the latched position. The latch body 62 also includes a secondary catch portion 66 configured to limit, such as constrain and/or maintain, position of the hood panel 52 as shown in FIG. 1 within a predetermined distance from the vehicle body 14 when the latching mechanism is in the first unlatched position. Such limiting of the position of the hood panel 52 by the secondary catch portion 66 within the predetermined distance of the vehicle body 14 is configured to generate an opening between the vehicle body 14 and the hood panel 52.

As shown in the Figures, the latch body 62 is a unitary body such that the primary catch portion 64 is in communication with the secondary catch portion 66 by a surface 68. However, it may be appreciated that the primary catch portion 64 and secondary catch portion 66 of the latch body 62 may be distinct components that work in unison or individually from each other. The surface 68 may be a contour of the latch body 62 and configured to guide the latch body 62, such as by establishing or defining a rotational path or motion thereof, via contact with a striker 70. The striker 70 of the latching mechanism 60 may be configured to cooperate with the latch body 62. The position of the hood panel 52 as shown in FIG. 1 is specifically limited to within the predetermined distance by an engagement between the secondary catch portion 66 and the striker 70.

As shown, the surface 68 is arranged at least between and connecting the primary catch portion 64 and the secondary catch portion 66. The surface 68 may define a curved path for contact with the striker 70. The latch 62 is mounted to the housing 72, while the housing 72 is in turn fixed to a portion of the vehicle body 14. The latch 62 may be mounted to the housing 72 via a fastener, such as a rivet or the like.

The housing 72 includes a first side, an opposing second side and at least one cam surface 74 formed therein. The first side of the housing 72 may receive the latch 62 pivotally connected thereto. The at least one cam surface 74 may be formed in a central region defined between the first side and the opposing second side of the housing 72 and is sized to receive and guide the striker 70 therethrough. The primary catch portion 64, secondary catch portion 66 and surface 68 *e* on the latch 62 are positioned adjacent the at least one cam surface 74 of the housing 72.

The latching mechanism 60 also includes a first resilient element 76, such as a clock spring or the like, configured to operate bi-directionally and apply a force to selectively preload the primary catch portion 64 in opposing directions. The first resilient element 76 may be configured such that, depending on the position of the deployable latch 62, the force of element 76 may be applied in one direction, or another, opposite direction. For example, as shown in FIGS. 1 and 2A-2B, the force of the first resilient element 76 is applied in a first direction, such as clockwise direction, to maintain the primary catch portion 64 in a latched or unactuated state in the first position to facilitate closure of the under-hood compartment 54 via the hood panel 52.

The latching mechanism 60 may also include a limiting member 78 configured to travel in a slot defining a range of motion for the latch 62. The limiting member 78 may cooperate with and extend from the housing 72 or may be a distinct component of the latching mechanism 60. The slot 80 may be formed in a portion of the latching mechanism 60 and may be formed in a variety of geometries and positions. In one non-limiting example, slot 80 may be arcuate in shape configured to define a predetermined angle of rotation for the latch 62 relative to a pivot center. The slot 80 may be sized to allow the limiting member 78 to travel therein and thereby, limit the range of motion of the limiting member 78 within the geometry defining the slot 80.

Referring now to FIG. 2B, the latching mechanism 60 may also include a fork bolt 82 cooperating with the actuator 94 and having a portion 84 configured to capture the striker 70 and thereby fasten the hood panel 52 to the vehicle body 14. The fork bolt 82 may be positioned on the housing 72 such that the fork bolt 82 and portion 84 of the fork bolt 82 are disposed proximate the at least one cam surface 74. In one non-limiting embodiment, the fork bolt 82 is pivotally connected to the second side of the housing 72 on the opposing surface from the latch 62.

The latching mechanism 60 may additionally include a device 86 pivotally connected to the second side of the housing 72 and configured to releasably engage the fork bolt 82. For example, the device 86 may be a cable, lever with a catch, and/or a solenoid actuated by the operator of the vehicle 10. The release of the fork bolt 82 frees the hood panel 52 to separate from the vehicle body 14 at least a predetermined distance and thereby establish an opening between the vehicle body 14 and the hood panel 52. The device 86 may be actuated remotely from the vehicle's passenger compartment 28 or by a remote activation device (not shown) to operatively release the fork bolt 82 to allow the striker 70 to be moved from the portion 84 of the fork bolt 82.

The latching mechanism 60 may additionally include a second resilient element or member, which may be configured as a clock spring or the like operatively connected to the fork bolt 82. The second resilient element or member may be configured to apply a preload force directed to rotatably position or move the fork bolt 82 relative to the housing from the first position or latched position to the second position or first unlatched position, where the fork bolt 82 releases the striker 70 and permits the hood panel 52 to move away from the vehicle body 14 in response to a first actuation of the detent or device 86. The fork bolt 82 along with the second resilient element or member may be operatively connected to the housing 72 via a suitable fastener 88, such as a rivet or the like.

A third resilient element or member may be provided to cooperate with the device 86. As shown, the third resilient element or member may be a spring or the like that may be configured to apply a force to at least a portion of the device 86 to release the fork bolt 82 from the first position to the second position in response to actuation of the device 86. The third resilient element or member may be operatively connected to the housing 72 via a suitable fastener 92.

FIGS. 2A-2B illustrate the latching mechanism 60 in a first or latched position. An actuator 94 cooperates with and extends from a portion of the device 86 and is configured to engage the latch 62. The actuator 94 may be operatively connected to a portion of the device 86 by a member 96, which may include a clock spring or the like. The member 96 may be configured to apply a preload force directed to shift the actuator 94 to a position where the actuator 94 engages a portion 104 of the latch 62 as will be described in greater detail below.

The actuator 94 may be positioned proximate the latch 62. As shown in the Figures, the actuator 94 may be disposed on one side of the housing 72 while the latch 62 is disposed on an opposing side of the housing 72. The actuator 94 includes a projection 98 extending from a surface of the actuator 94. The projection 98 may be configured to engage at least one surface of the latch 62. The projection 98 may be of a unitary structure with the actuator 94 and may be disposed adjacent a lower surface 100 of the latch 62 in FIGS. 2A-2B.

Figure 3A:
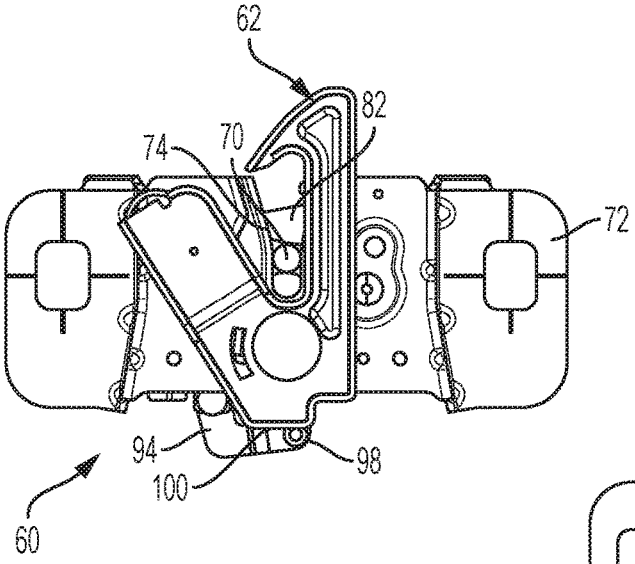
FIGS. 3A-3B are schematic front and rear views of the mechanism shown in a first unlatched position.
Figure 3B:
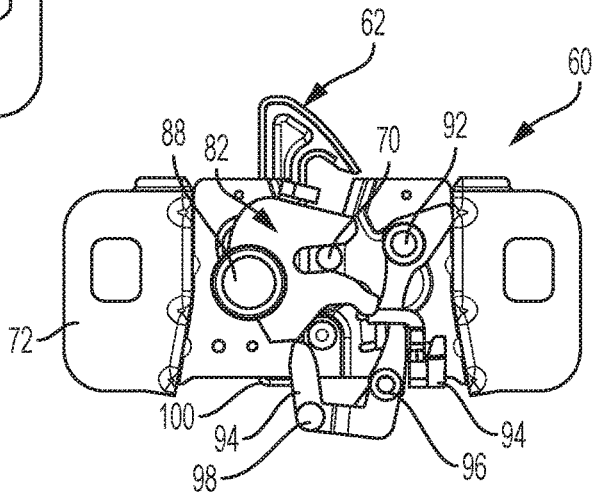

Referring now to FIGS. 3A-3B, the latching mechanism 60 is illustrated in a second position or first unlatched position. In this second position, the device 86 may be actuated to release the fork bolt 82 from engagement with the device 86. As illustrated in FIGS. 3A-3B, the device 86 rotates about the third resilient element or member between the first position and the second position or first unlatching position. The second resilient element or member may apply a force to shift the fork bolt 82 in a counterclockwise manner to a position where the fork bolt 82 releases the striker 70 when the device 86 releases the fork bolt 82. In response to movement of the device 86, the actuator 94 may adjust about the member 96 such that the projection 98 on actuator 94 is disposed proximate the lower surface 100 of the latch 62. It is contemplated that the projection 98 may engage the lower surface 100 of the latch 62.

Figure 4A:
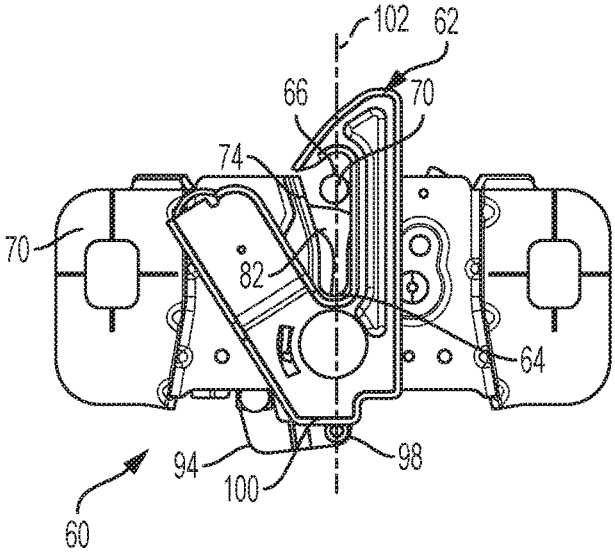
FIGS. 4A-4B are schematic front and rear views of the mechanism shown in a transition between the first unlatched position and a second unlatched position.
Figure 4B:
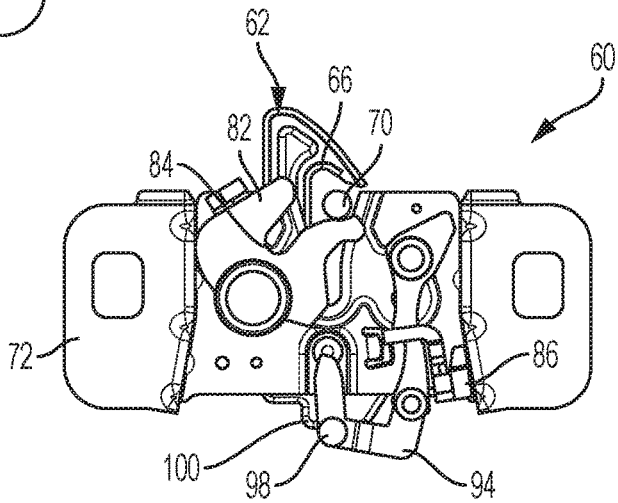

Referring now to FIGS. 4A-4B, the latching mechanism 60 is shown at a completion of the second position or first unlatching position. As shown in FIGS. 3A-3B, the striker 70 may be positioned at least partially within the portion 84 of the fork bolt 82 and adjacent the primary catch portion 64 of the latch 62. In FIGS. 4A-4B, the striker 70 has traveled between the first position shown in FIGS. 2A-2B and the second position and at least partially through the cam surface 74 in the housing 72.

The latch 62 may be configured such that the secondary catch portion 66 extends generally above a central region 102 of the latching mechanism 60 to releasably engage and receive the striker 70 in the secondary catch portion 66 as the striker 70 moves to the full travel position of the second position. The secondary catch portion 66 may also provide physical feedback to the device 86 and related components to indicate completion of the second position movement.

Figure 5A:
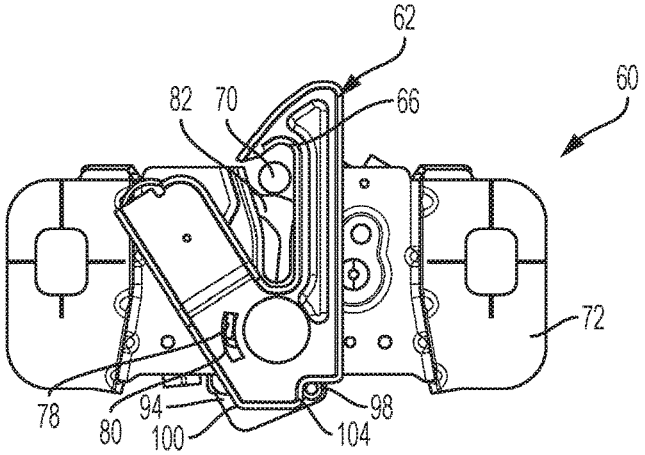
FIGS. 5A-5B are schematic front and rear views of a mechanism shown in the second unlatched position.
Figure 5B:
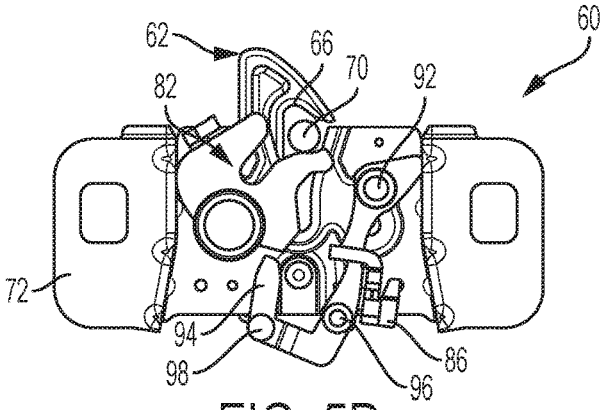

Referring now to FIGS. 5A-5B, in response to positioning of the striker 70 in the secondary catch portion 66, the device 86 is repositioned to the first or latched position as shown in FIGS. 2A-2B. As the device 86 is repositioned, the actuator 94 translates about the member 96 such that the projection 98 of actuator 94 is placed in a portion 104 of the lower surface 100 of the deployable latch 62.

Figure 6A:
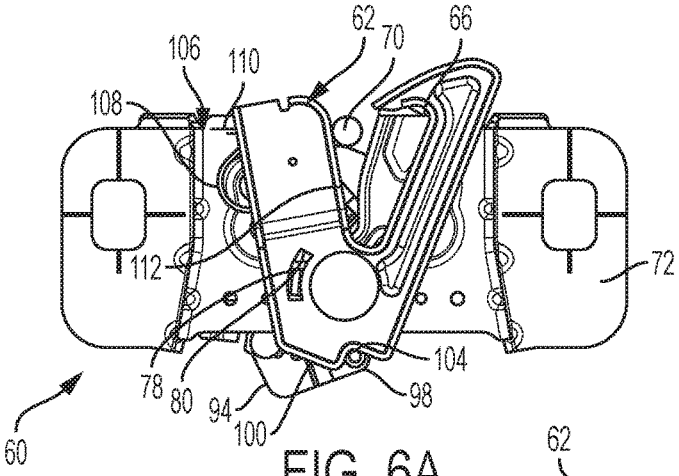
FIGS. 6A-6B are schematic front and rear views of a mechanism shown in another view of the second unlatched position.
Figure 6B:
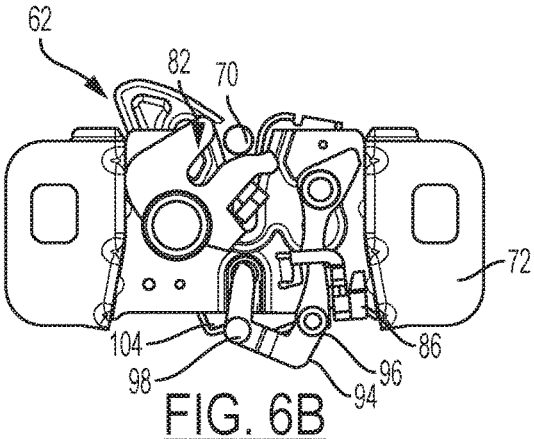

Referring now to FIGS. 6A-6B, adjustment of the latching mechanism 60 from the second position or first unlatching position to a third position or second unlatching position is described in greater detail. The latching mechanism 60 includes a fourth resilient element 106 having a first portion 108 positioned on the housing 72 and a second portion operatively engaging the latch 62. The fourth resilient element 106 may be a spring or the like and is biased to retain the secondary catch portion 66 of the latch 62 adjacent the central region 102 of the latching mechanism 60 and, thereby, retaining the striker 70 in the secondary catch portion 66.

In one non-limiting embodiment, the fourth resilient element 106 may be biased to maintain the latch in the second unlatched position after the latch 62 is rotated over the center point of travel as described and shown in FIG. 4A. The biasing of the fourth resilient element 106 with latch 62 allows the latch 62 to be opened after the latching mechanism 60 is actuated a second time. The cam surface 74 on the latching mechanism 60 drives the latch 62 towards the second position or the first unlatched position when the hood panel is moved toward the vehicle body into the first position or latched position.

When the device 86 is actuated into the third position or second unlatching position, the actuator 94 cooperating with device 86 is adjusted such that projection 98 engages the portion 104 of the lower surface 100 of the latch 62, thereby translating the latch 62 from the first position or latched position to at least one second position or unlatched position shown in FIGS. 6A-6B. The limiter 78 may be configured to travel in the slot 80 of latch 62 is adjusted between a first position to a second position. The second position of the slot 80 defines the predetermined angle of rotation for the latch 62 relative to a pivot center and thereby, limits the range of motion of the limiter 78 within the geometry defining the slot 80.

Figure 7A:
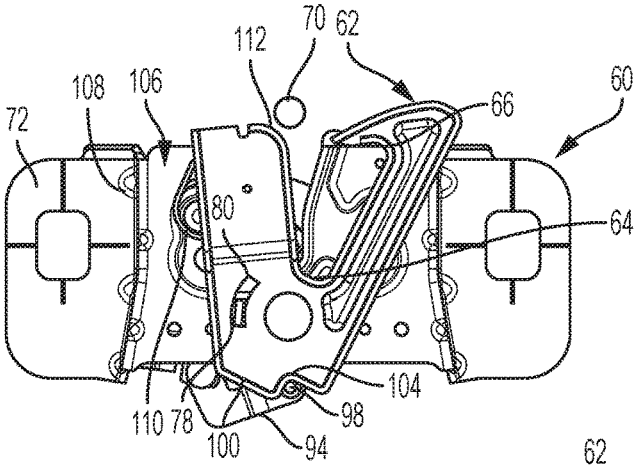
FIGS. 7A-7B are schematic front and rear views of a mechanism shown in transition from the second unlatched position to a relatched position.
Figure 7B:
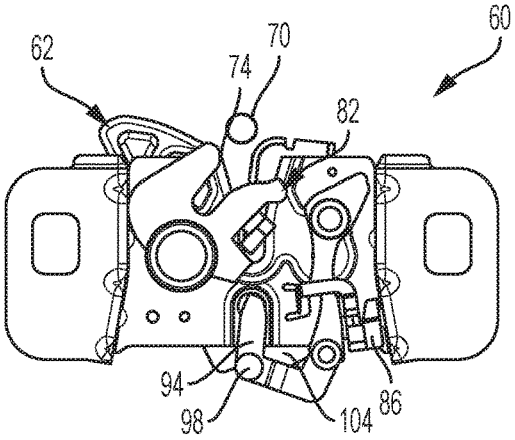

Referring now to FIGS. 7A-7B, movement of the latch 62 from the third position or second unlatched position to a fourth position or a third unlatched position. The fourth position may also be referred to as a fully unlatched position. The striker 70 may be removed from the latching mechanism 60 adjusts the secondary catch portion 66 from a position proximate the central region 102 of the latching mechanism 60 to a released position disposed away from the central region 102 and the second portion of the fourth resilient element 106 extends away from the first portion 108 in response to the adjustment of the latch 62. In response to positioning of the latch 62 in the fourth position or the third unlatched position, the striker 70 is adjusted from the secondary catch portion 66 to a surface 112 on an opposing side of the latch 62 from the surface 68 extending between the primary catch portion 64 and secondary catch portion 66.

Figure 8A:
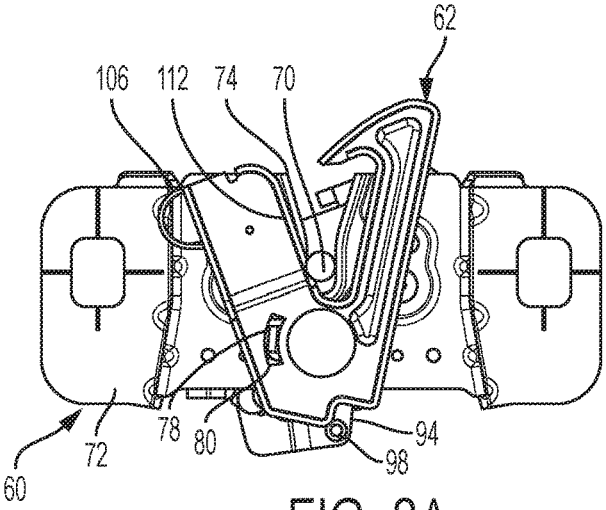
FIGS. 8A-8B are schematic front and rear views of the mechanism shown in the relatched position wherein the mechanism releasably engages a striker to selective fasten the hood panel to the vehicle body according to the disclosure.
Figure 8B:
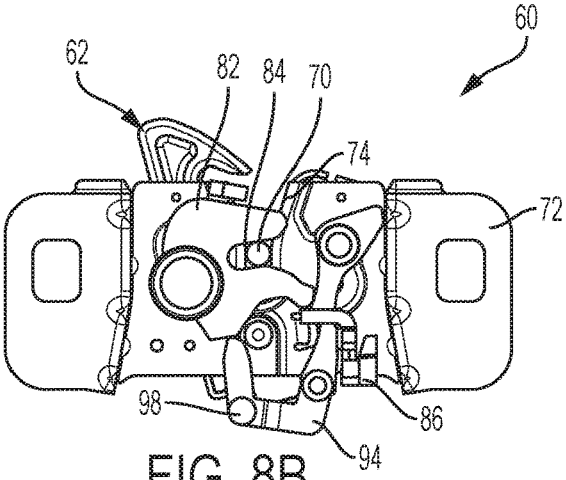

Referring now to FIGS. 8A-8B, the latching mechanism 60 is shown in the first position or relatched position as the striker 70 is positioned in the latching mechanism 60 to relatch the striker in the portion 84 of the fork bolt 82. As shown in FIGS. 7A-7B, the fork bolt 82 is positioned on the housing 72 such that the portion 84 of the fork bolt 82 is aligned with the at least one cam surface 74. When the hood 52 is positioned adjacent the vehicle body 14, the striker 70 travels through the at least one cam surface 74 into and engaging the portion 84 of the fork bolt 82 to place the fork bolt 82 in the first or latched position. The striker 70 further engages the surface 112 of the latch 62 and cooperates with the fourth resilient element 106 to reposition the latch 62 from the at least one second or unlatched position to the first or latched position, and thereby, the secondary catch portion 66 of the latch 62 is placed proximate the central region 102 of the housing 72 and latching mechanism 60.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A vehicle comprising:

a vehicle body defining a compartment;

a hood panel configured to cover the compartment, the hood panel including a striker extending therefrom; and a latching mechanism releasably engaging the striker, the latching mechanism including:

a housing securable to a portion of the vehicle body, the housing having a first side, an opposing second side and at least one cam surface formed in a central region of the housing, wherein at least one cam surface is sized to receive and guide the striker, a fork bolt pivotally connected to the second side of the housing and rotatably positionable between a latched position and a first unlatched position, wherein the fork bolt includes a channel configured to capture the striker to fasten the hood panel to the vehicle body in the latched position, a device pivotally connected to the second side of the housing adjacent the fork bolt and adjustable between the latched position and the first unlatched position, wherein the device engages the fork bolt in the latched position and releases the fork bolt in the first unlatched position, a latch including a latch body pivotally connected to the first side of the housing, wherein the latch body is rotatably positionable between at least one of the latched position, the first unlatched position and a second unlatched position, wherein the latch body includes a primary catch portion configured to releasably engage the striker in the latched position and a secondary catch portion configured to releasably engage the striker in the first unlatched position, and an actuator connected to the housing and operatively connected to the device, wherein the actuator includes a projection configured to engage a portion of the latch body to adjust the latch body between the first unlatched position and the second unlatched position, wherein the secondary catch portion of the latch body releases the striker in the second unlatched position to unfasten the hood panel from the vehicle body when the latch body is adjusted from the first unlatched position to the second unlatched position by the projection of the actuator.

2. The vehicle of claim 1 wherein the latching mechanism further comprises a limiting segment extending from the housing and at least partially through an arcuate slot formed in the latch body, wherein the limiting segment cooperates with the arcuate shaped slot the to define a range of travel of the latch body between a the latched position and the first unlatched position.

3. The vehicle of claim 1 wherein the striker cooperates with the primary catch portion of the latch body when the latching mechanism is in the latched position to selectively fasten the hood panel to the vehicle body.

4. The vehicle of claim 1 wherein the latch body of the latching mechanism further comprises a surface arranged between the primary catch portion and the secondary catch portion that is configured to guide the striker between the primary catch portion and the secondary catch portion when the striker is adjustably positioned between the latched position and the first unlatched position.

5. The vehicle of claim 1 wherein the latching mechanism further comprises a first resilient element configured to selectively apply a force to preload the latch to facilitate closure of the compartment in the latched position and preload the secondary catch portion to limit the position of the hood panel in the first unlatched position.

6. The vehicle of claim 1 wherein the latching mechanism further comprises a second resilient element configured to apply a preload force directed to move the fork bolt from the latched position to the first unlatched position to move the hood panel away from the vehicle body.

7. The vehicle of claim 1 wherein the latching mechanism further comprises a third resilient element configured to apply a force to the device to release the fork bolt from the latched position to the first unlatched position in response to actuation of the device.

8. The vehicle of claim 1 wherein the latching mechanism further comprises a fourth resilient element having a first portion positioned on the housing and a second portion operatively engaging the latch body, wherein the fourth resilient element is biased to retain the secondary catch portion of the latch body adjacent the central region of the housing to retain the striker in the secondary catch portion in the first unlatched position.

9. A latching mechanism releasably engaging a striker of a hood panel to selectively fasten the hood panel to a vehicle body, the latching mechanism comprising:

a housing securable to a portion of the vehicle body, the housing having a first side, an opposing second side and at least one cam surface formed in a central region of the housing, wherein at least one cam surface is sized to receive and guide the striker;

a fork bolt pivotally connected to the second side of the housing and rotatably positionable between a latched position and a first unlatched position, wherein the fork bolt includes a channel configured to capture the striker to fasten the hood panel to the vehicle body in the latched position;

a device pivotally connected to the second side of the housing adjacent the fork bolt and adjustable between the latched position and the first unlatched position, wherein the device engages the fork bolt in the latched position and releases the fork bolt in the first unlatched position;

a latch including a latch body pivotally connected to the first side of the housing, wherein the latch body is rotatably positionable between at least one of the latched position, the first unlatched position and a second unlatched position, wherein the latch body includes a primary catch portion configured to releasably engage the striker in the latched position and a secondary catch portion configured to releasably engage the striker in the first unlatched position; and an actuator connected to the housing and operatively connected to the device, wherein the actuator includes a projection configured to engage a portion of the latch body to adjust the latch body between the first unlatched position and the second unlatched position, wherein the secondary catch portion of the latch body releases the striker in the second unlatched position to unfasten the hood panel from the vehicle body when the latch body is adjusted from the first unlatched position to the second unlatched position by the projection of the actuator.

10. The latching mechanism of claim 9 further comprising a limiting segment extending from the housing and at least partially through an arcuate slot formed in the latch body, wherein the limiting segment cooperates with the arcuate shaped slot to define a range of travel of the latch body between a the latched position and the first unlatched position.

11. The latching mechanism of claim 9 wherein the latch body further comprises a surface arranged between the primary catch portion and the secondary catch portion that is configured to guide the striker between the primary catch portion and the secondary catch portion when the striker is adjustably positioned between the latched position and the first unlatched position.

12. The latching mechanism of claim 9 further comprising a first resilient element configured to selectively apply a force to preload the latch to facilitate closure of a compartment in the latched position and preload the secondary catch portion to limit the position of the hood panel in the first unlatched position.

13. The latching mechanism of claim 9 further comprising a second resilient element configured to apply a preload force directed to move the fork bolt from the latched position to the first unlatched position to move the hood panel away from the vehicle body.

14. The latching mechanism of claim 9 further comprising a third resilient element configured to apply a force to at least a portion of the device to release the fork bolt from the latched position to the first unlatched position in response to actuation of the device.

15. The latching mechanism of claim 9 further comprises a fourth resilient element having a first portion positioned on the housing and a second portion operatively engaging the latch body, wherein the fourth resilient element is biased to retain the secondary catch portion of the latch body adjacent the central region of the housing to retain the striker in the secondary catch portion in the first unlatched position.

16. A latching mechanism configured to releasably engaging a striker of a hood panel to selectively fasten the hood panel to a vehicle body, the latching mechanism comprising:

a housing securable to a portion of the vehicle body, the housing having a first side, an opposing second side and at least one cam surface formed in a central region of the housing, wherein at least one cam surface is sized to receive and guide the striker;

a fork bolt pivotally connected to the second side of the housing and rotatably positionable between a latched position and a first unlatched position, wherein the fork bolt includes a channel configured to capture the striker to fasten the hood panel to the vehicle body in the latched position;

a device pivotally connected to the second side of the housing adjacent the fork bolt and adjustable between the latched position and the first unlatched position, wherein the device engages the fork bolt in the latched position and releases the fork bolt in the first unlatched position;

a latch including a latch body pivotally connected to the first side of the housing, wherein the latch body is rotatably positionable between at least one of the latched position, the first unlatched position and a second unlatched position, wherein the latch a body includes a primary catch portion configured to releasably engage the striker in the latched position and a secondary catch portion configured to releasably engage the striker in the first unlatched position;

a first resilient element configured to selectively apply a force to preload the latch to facilitate closure of a compartment of the vehicle body in the latched position and preload the secondary catch portion to limit the position of the hood panel in the first unlatched position;

a second resilient element configured to apply a preload force directed to move the fork bolt from the latched position to the first unlatched position to move the hood panel away from the vehicle body;

a third resilient element configured to apply a force to the device to release the fork bolt from the latched position to the first unlatched position in response to actuation of the device;

a fourth resilient element having a first portion positioned on the housing and a second portion operatively engaging the latch body, wherein the fourth resilient element is biased to retain the secondary catch portion of the latch body adjacent the central region of the housing to retain the striker in the secondary catch portion in the first unlatched position; and an actuator connected to the housing and operatively connected to the device, wherein the actuator includes a projection configured to engage a portion of the latch body to adjust the latch body between the first unlatched position and the second unlatched position, wherein the secondary catch portion of the latch body releases the striker in the second unlatched position to unfasten the hood panel from the vehicle body when the latch body is adjusted from the first unlatched position to the second unlatched position by the projection of the actuator.

17. The latching mechanism of claim 16 further comprising a limiting segment extending from the housing and at least partially through an arcuate slot formed in the latch body, wherein the limiting segment cooperates with the arcuate shaped slot to define a range of travel of the latch body between a the latched position and the first unlatched position.

* * * * *